US005511303A

United States Patent [19]

Tippins et al.

[11] Patent Number: 5,511,303

[45] **Date of Patent: *Apr. 30, 1996**

[54] INTERMEDIATE THICKNESS AND MULTIPLE FURNACE PROCESS LINE

[75] Inventors: George W. Tippins; John E. Thomas, both of Pittsburgh, Pa.

[73] Assignee: Tippins Incorporated, Pittsburgh, Pa.

[ * ] Notice: The term of this patent shall not extend beyond the expiration date of Pat. No. 5,276,952.

[21] Appl. No.: 371,408

[22] Filed: Jan. 11, 1995

Related U.S. Application Data

[63] Continuation-in-part of Ser. No. 123,149, Sep. 20, 1993, Pat. No. 5,414,923, which is a continuation of Ser. No. 881,615, May 12, 1992, Pat. No. 5,276,952.

[51] Int. Cl.[6] ..... B21B 1/00; B21B 13/22

[52] U.S. Cl. ..... 29/527.7; 29/33 C; 29/DIG. 5; 72/202; 72/229

[58] Field of Search ..... 29/527.7, 33 C, 29/DIG. 5; 72/200, 202, 229

[56] References Cited

U.S. PATENT DOCUMENTS

| | | | |
|---|---|---|---|
| 611,565 | 9/1898 | Daniels . | |
| 1,622,060 | 3/1927 | Stoop . | |
| 1,808,033 | 6/1931 | George et al. . | |
| 3,693,701 | 9/1972 | Waclawiczek | 164/260 |
| 3,757,556 | 9/1973 | Kawawa et al. | 72/234 |
| 4,067,220 | 1/1978 | Hoffmann | 72/201 |
| 4,229,878 | 10/1980 | Ushijima | 29/527.7 |
| 4,344,309 | 8/1982 | Matsuzaki | 72/199 |
| 4,503,697 | 3/1985 | Tippins et al. | 72/202 |
| 4,630,352 | 12/1986 | Ginzburg et al. | 29/527.7 |
| 4,698,897 | 10/1987 | Frommann et al. | 29/527.7 |
| 4,791,799 | 12/1988 | Engel et al. | 72/225 |
| 4,793,169 | 12/1988 | Ginzburg | 72/240 |
| 4,848,127 | 7/1989 | Isobe et al. | 72/206 |
| 4,958,677 | 9/1990 | Kimura | 164/452 |
| 5,042,564 | 8/1991 | Van Perlstein et al. | 164/476 |
| 5,082,047 | 1/1992 | Bricmont | 164/476 |
| 5,113,678 | 5/1992 | Mannaka et al. | 72/8 |
| 5,121,873 | 6/1992 | Sekiya et al. | 228/170 |
| 5,133,205 | 7/1992 | Rostik et al. | 72/200 |
| 5,150,597 | 9/1992 | Sekiya et al. | 72/229 |

OTHER PUBLICATIONS

N. Zentara et al., "Optimisation of hot rolling schedule for direct charging of thin slabs of Nb–V microalloyed steel", *Materials Science and Technology,* May 1994, vol. 10, pp. 370–376.

*Primary Examiner*—Carl J. Arbes
*Attorney, Agent, or Firm*—Webb Ziesenheim Bruening Logsdon Orkin & Hanson

[57] ABSTRACT

A method and apparatus of making coiled plate, sheet in coiled form or discrete plate. The apparatus includes a continuous strip caster forming a strand of intermediate thickness; a shear for cutting the strand into a slab of desired length; a slab table including a slab takeoff operable transverse of the conveyor table; a slab collection and storage area adjacent to the slab conveyor table adapted to receive slabs from the slab takeoff; one or two reheat furnaces having an entry inline with both the slab conveyor table and the slab collection and storage area for receiving slabs from either; a feed and run back table at the exit of one reheat furnace; a single or twin stand hot reversing mill for reducing the slab to a coiling thickness in a number of flat passes; and a pair of coiler furnaces located on opposite sides of the hot reversing mill.

24 Claims, 2 Drawing Sheets

INTERMEDIATE THICKNESS AND MULTIPLE FURNACE PROCESS LINE

This is a continuation-in-part of U.S. patent application Ser. No. 08/123,149, filed on Sep. 20, 1993, now U.S. Pat. No. 5,419,923 which is a continuation of U.S. patent application Ser. No. 07/881,615, filed on May 12, 1992, now U.S. Pat. No. 5,276,952.

FIELD OF THE INVENTION

This invention relates to the continuous casting and rolling of slabs and, more particularly, to an integrated intermediate thickness caster and a hot reversing mill with flexibility in slab sourcing and the ability to roll thin gauge products.

BACKGROUND OF THE INVENTION

Since the advent of the continuous casting of slabs in the steel industry, companies have been trying to combine the hot strip mill with the continuous caster through an inline arrangement so as to maximize production capability and minimize the equipment and capital investment required. The initial efforts in this regard consisted of integrating continuous casters producing slabs on the order of 6 to 10 inches with existing continuous or semicontinuous hot strip mills. These existing hot strip mills included a reheat furnace, a roughing train (or a reversing rougher) and a six or seven stand finishing mill with a capacity of 1.5 to 5 million tons per year. This arrangement is the present day design of large steel company hot mills, and it is unlikely that new hot strip mills of this design would ever be built due to the high capital cost. The quest for low cost integrated caster hot strip mills is not solved by current designs. Further, such prior art integrated mills were extremely inflexible as to product mix and thus current market requirements.

These difficulties gave rise to the development of the so-called thin slab continuous hot strip mill which typically produces 1,000,000 tons of steel per year as standard products. These mills have been integrated with thin slab casters on the order of 2 inches or less. Such integrated thin slab casters are enjoying increased popularity but are not without serious drawbacks of their own. Significant drawbacks include the quality and quantity limitations associated with the thin slab casters. Specifically, the trumpet-type mold necessary to provide the metal for the thin slab can cause high frictional forces and stresses along the surface of the thin wall slab which leads to poor surface quality in the finished product. Further, the 2 inch strip casters are limited to a single tundish life of approximately seven heats because of the limited metal capacity of the mold.

Most importantly, the thin casters, by necessity, have to cast at high speeds to prevent the metal from freezing in the current ladle arrangements. This, in turn, requires the tunnel furnace which is just downstream of the slab caster to be extremely long, often on the order of 500 feet, in order to accommodate the speed of the slab and still be able to provide the heat input to a thin slab (2 inches) which loses heat at a very high rate. Since the slab also leaves the furnace at a high speed, one needs the multistand continuous hot strip mill to accommodate the rapidly moving strip and roll it to sheet and strip thicknesses. However, such a system is still unbalanced at normal widths since the caster has a capacity of about 800,000 tons per year and the continuous mill has a capacity as great as 5 million tons per year. The capital cost of such a system then approaches that of the earlier prior art systems which the system was intended to replace.

In addition, the scale loss as a percentage of slab thickness is substantial for the 2 inch thin cast slab. Because of the extremely long furnace, one must provide a long roller hearth which becomes very maintenance intensive because of the exposed rotating rollers.

It has been suggested that light gauge hot band on the order of 0.040 inch be rolled from these 2 inch slabs. However, in the case of low carbon steels, the thermal decay is too great on a multistand continuous mill making it impossible to achieve the necessary finishing temperatures; and in the case of low alloy high-strength steels, it has been reported that the 2 inch thick slab does not produce the reduction required for high-strength low alloy steel which then causes a coarse microstructure which must then be refined through special temperature treatments which are greater than for the cold charging of the same microalloyed steel grade, "Optimisation of hot rolling schedule for direct charging of thin slabs of Nb-V microalloyed steel", N. Zentara and R. Kaspar, *Materials Science and Technology*, May 1994.

The typical multistand hot strip mill, likewise, requires a substantive amount of work in a short time which must be provided for by larger horsepower rolling stands which, in some cases, can exceed the energy capabilities of a given area, particularly in the case of emerging countries. Thin slab casters, likewise, are limited as to product width because of the difficulty in using vertical edgers on a 2 inch slab. Further problems associated with the thin strip casters include the problems associated with keeping the various inclusions formed during steel-making away from the surface of the thin slab where such inclusions can lead to surface defects if exposed. Furthermore, existing systems are limited in scale removal because thin slabs lose heat rapidly and are thus adversely affected by the high-pressure water normally used to break up the scale.

In addition, this thin strip process can only operate in a continuous manner, which means that a breakdown anywhere in the process stops the entire line, often causing scrapping of the entire product then being processed.

It is an object of our invention to integrate an intermediate thickness slab caster with a hot reversing mill. It is a further object to adopt a system which balances the rate of the caster to the rate of the rolling mill. It is also an object of our invention to adopt a system using less thermal and electrical energy. It is still a further object to adopt an automated system with small capital investment, reasonable floor space requirements, reasonably powered rolling equipment and low operating costs. It is a further object to provide flexibility in slab sourcing and to economically accommodate increased demand for light gauge wide strip.

SUMMARY OF THE INVENTION

Our invention provides for a versatile, integrated caster and minimill capable of producing at least 650,000 and preferably in excess of 1 million finished tons a year with a divergent product mix. Such a facility can produce product 24 to 120 inches wide and can routinely produce a product of 800 PIW with 1,200 PIW being possible. This is accomplished using a casting facility having a fixed and adjustable width mold with a straight, rectangular cross section without the trumpet-type mold. The caster has a mold which contains enough liquid volume to provide sufficient time to make flying tundish changes, thereby not limiting the caster run to a single tundish life. Our invention provides a slab approximately two to three times as thick as the thin cast slab, thereby losing much less heat and requiring a lesser input of Btu's of energy. Our invention provides a slab having a lesser scale loss due to reduced surface area per volume and permits the use of one or two reheat or equalizing furnaces with minimal maintenance required. Further, our invention provides a caster which can operate at conventional caster speeds and conventional descaling techniques. Our invention provides for the selection of the optimum thickness cast slab to be used in conjunction with a twin stand, tandem hot reversing mill providing a balanced production capability. Our invention has the ability to separate the casting from the rolling if there is a delay in either end. Our invention provides for the easy removal of transitional slabs formed when molten metal chemistry changes or width changes are made in the caster. Furthermore, our invention provides for easily bringing cold slabs into the processing line. Such slabs may be outsourced (i.e., slabs not formed by the caster) and may be thicker than those which may be cast by the caster. This versatility will allow the processing line to be operated at the respective capacity of the individual components and allows for various portions of the line to be independently operated. This outsourcing of slabs also permits the product mix to include steel grades beyond the capability of the steel-making facility which forms a part of any given integrated process.

All of the above advantages are realized while maintaining the advantages of a thin caster which include low ferrostatic head, low weight of slab, straight molds, shorter length molds, smaller required mold radii, low cooling requirements, low burning costs or shear capacity and simplified machine constructions.

Our invention provides an intermediate thickness slab caster integrated with a hot strip and plate line which includes a pair of reheat or equalizing furnaces capable of receiving slabs directly from the caster, from a slab collection and storage area positioned adjacent a slab conveyor table exiting the continuous caster or from another area. A feed and run back table is positioned at the exit end of one of the reheat furnaces and inline with a twin stand hot reversing mill having a coiler furnace positioned on either side thereof. The mill can reduce a cast slab to a thickness of about 1 inch or less in about four flat passes. The combination coil, coiled plate, sheet in coil form or discrete plate finishing line extends inline and downstream of the hot reversing mill and the coiler furnaces. The finishing facilities may include a cooling station, a downcoiler, a plate table, a shear, a cooling bed crossover, a plate side and end shear and a piler.

To achieve the necessary balance between the hot reversing mill and the caster, it is preferable to cast slabs having a thickness of 3 to 6 inches and preferably between about 3.5 to about 5.5 inches. As used herein, the term intermediate thickness is intended to define such slabs. The cast slabs are reduced to a thickness capable of being coiled and normally about 1 inch or less in four flat passes on the hot reversing mill before starting the coiling of the intermediate product between the coiler furnaces as it is further reduced to the desired finished product thickness. In order to provide the capability of making coiled plate, discrete plate and sheet in coil form up to 1,000 PIW and higher, slab width may vary from 24 to 120 inches.

A preferred processing line of the present invention includes an intermediate thickness continuous strip caster with an inline shear downstream of the caster for cutting a cast strand into an intermediate thickness slab of the desired length. A slab conveyor table is provided inline with the shear and a slab loading and unloading mechanism positioned adjacent the conveyor for supplying slabs thereto. A slab collection and storage area is adjacent the slab loading and unloading mechanism for receiving and supplying slabs thereto. At least one reheat furnace is provided having an entry end inline with the slab conveyor table for receiving slabs therefrom and supplying reheated slabs to a feed and run back table positioned at the exit end of the reheat furnace. A hot reversing mill is provided inline with the feed and run back table for reducing a slab on the feed and run back table to an intermediate product having a thickness sufficient for coiling in a number of flat passes. Two spaced coiler furnaces are positioned inline with the feed and run back table, with one located upstream of the hot reversing mill and the other located downstream thereof. The coiler furnaces are capable of receiving and paying out the intermediate product as it is passed between the coiler furnaces and through the hot reversing mill so as to be reduced to an end product. A finishing line is provided downstream and inline with the coiler furnaces and the hot reversing mill.

In the preferred apparatus, the hot reversing mill includes a pair of four-high rolling mill stands adapted to be operated in tandem with an adjustable vertical edger positioned between the pair of rolling mill stands. Additionally, the slab loading and unloading means includes a first slab transfer device adjacent the slab conveyor table and operable transverse to the slab conveyor table, wherein the feed and run back table is positioned adjacent an end of the first slab transfer device. A second slab transfer device is adjacent the feed and run back table, wherein the slab collection and storage area is adapted to receive slabs from and supply slabs to the second slab transfer device. Additionally, the preferred embodiment of the present invention includes a second reheat furnace having an entry end inline with a feed and run back table and an exit end inline with the slab conveyor table.

The preferred method of operation of processing coil plate, sheet in coil form or discrete plate according to the present invention includes providing an intermediate thickness continuous caster and inline shear for casting an intermediate thickness strand and shearing the strand into a slab of predetermined length. Additionally, a slab loading and unloading device adjacent the slab collection and storage area for moving slabs between a position inline with the intermediate thickness caster and the slab collection and storage area is provided.

A slab originating from either the intermediate thickness caster or the slab collection and storage area is fed to an inline heating furnace. The slab to be reduced is extracted from the inline heating furnace onto a continuous processing line which includes a hot reversing mill having a coiler furnace on each of the upstream and downstream sides thereof. The slab to be worked is passed back and forth through the reversing mill to form an intermediate product of a thickness capable of being coiled. The intermediate product is coiled in one of the coiler furnaces. The coiled intermediate product is passed back and forth through the mill to reduce the coiled intermediate product to an end product of desired thickness, the intermediate product being collected in and fed out of each of the coiler furnaces on each pass through the hot reversing mill. The end product may be finished into one of either coiled plate, discrete plate or sheet in coil form.

The method according to the present invention also provides that some of the slabs supplied to the heating furnace may be outsourced (i.e., slabs which were not cast in the intermediate thickness caster). These outsourced slabs may have a thickness greater than slabs cast by the intermediate thickness caster and/or a chemistry different from that which can be produced on the melting/refining furnace(s) associated with the caster. The hot reversing mills of the present invention include a pair of rolling mill stands adapted for operation in tandem further including an adjustable vertical edger positioned between the pair of rolling mill stands. The preferred method of the present invention includes a second heating furnace adjacent the inline heating furnace to provide for a wide versatility in slab sourcing, sequencing and processing, as will be described in detail herein.

DESCRIPTION OF THE PREFERRED EMBODIMENT

Figure 1:
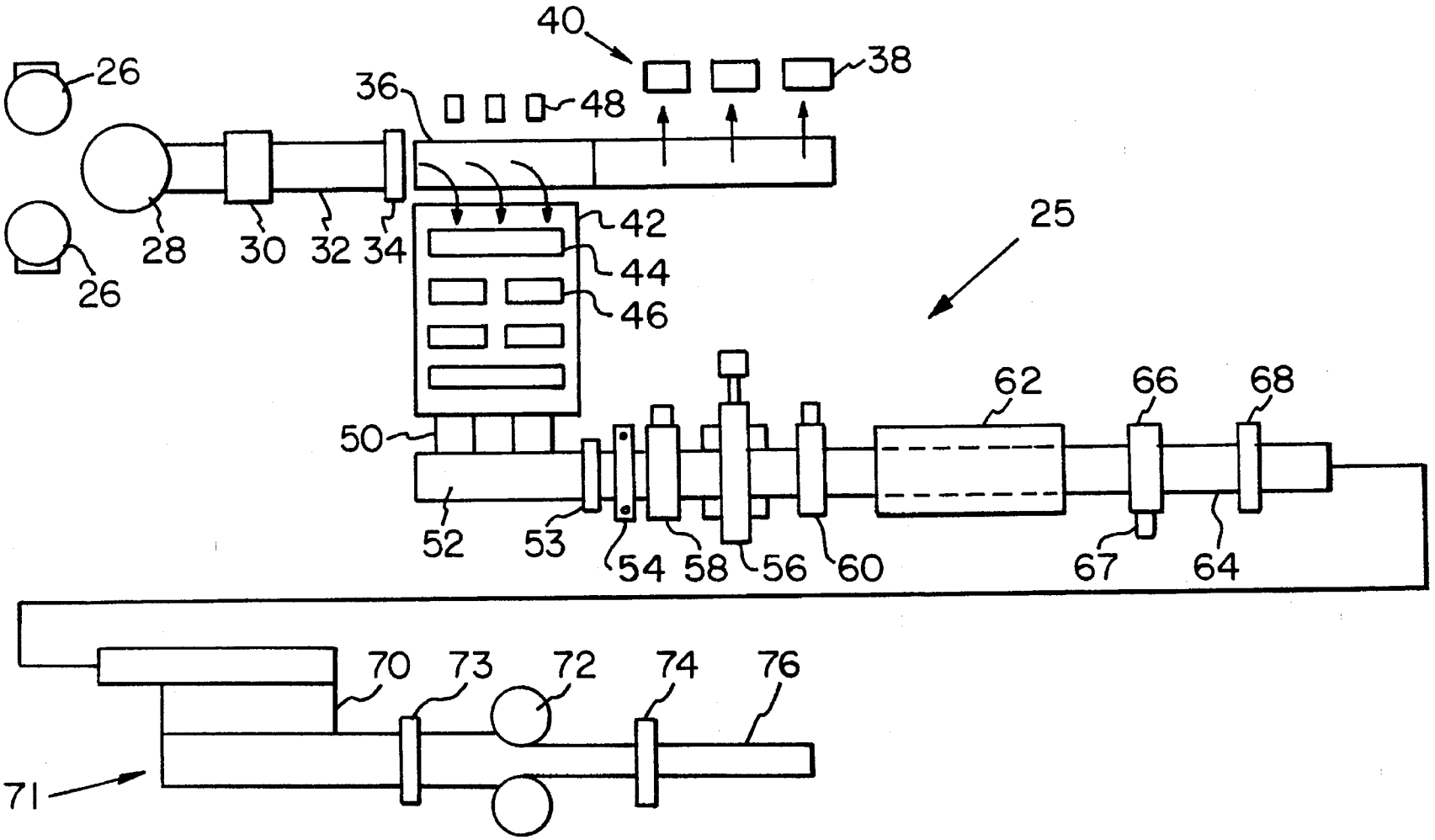
FIG. 1 is a schematic illustrating an intermediate thickness strip caster and inline hot reversing mill and coiler furnace arrangement according to one embodiment of the present invention.

The intermediate thickness slab caster and inline hot strip and plate line of one embodiment of the present invention is illustrated in FIG. 1 and was discussed in greater detail in the aforementioned parent application. One or more electric melting furnaces 26 provide molten metal at the entry end of the combination caster and strip and plate line 25, which is fed into a ladle furnace 28 prior to caster 30 and (curved or straight) mold 32 of rectangular cross section. A torch cutoff or shear 34 at the exit of mold 32 cuts the solidified metal strand into an intermediate thickness slab of the desired length which also has a width of 24 to 120 inches.

The slab then feeds on a conveyor table 36 to a slab takeoff area where it may be directly charged into a furnace 42 or may be removed from the inline processing and stored in a slab collection and storage area 40. The preferred furnace is of the walking beam type, although a walking hearth furnace could also be utilized in certain applications. Full-size slabs 44 and discrete length slabs 46 for certain plate products are shown within walking beam furnace 42. Slabs 38 which are located in the slab collection and storage area 40 may also be fed into the furnace 42 by means of slab pushers 48 or charging arm devices located for indirect charging of walking beam furnace 42 with slabs 38. It is also possible to charge slabs from other slab yards or storage areas. Because the intermediate thickness slabs retain heat to a much greater extent than the 2 inch thin slabs, temperature equalization is all that is required in many modes of operation. Of course, where slabs are introduced from off-line locations, the furnace 42 must have the capacity to add Btu's to bring the slabs up to rolling temperatures.

Slab extractors 50 remove slabs from furnace 42 and position them onto a feed and run back table 52. Descaler 53 and/or a vertical edger 54 may be utilized on the slabs. A vertical edger normally could not be used with a slab of only 2 inches or less.

Downstream of feed and run back table 52 and vertical edger 54 is a hot reversing mill 56 having upstream and downstream coiler furnaces 58 and 60, respectively. Cooling station 62 is downstream of coiler furnace 60. Downstream of cooling station 62 is a coiler 66 operated in conjunction with a coil car 67 followed by a plate table 64 operated in conjunction with a shear 68. The final product is either coiled on coiler 66 and removed by coil car 67 as sheet in strip or coil plate form or is sheared into plate form for further processing inline. A plate product is transferred by transfer table 70, which includes a cooling bed, onto a final processing line 71. The final processing line 71 includes a plate side shear 72, plate end shear 74 and plate piler 76.

The aforementioned parent application contains several specific examples for the processing line of FIG. 1, including the appropriate rolling schedules to illustrate the wide range of products that can be produced.

Figure 2:
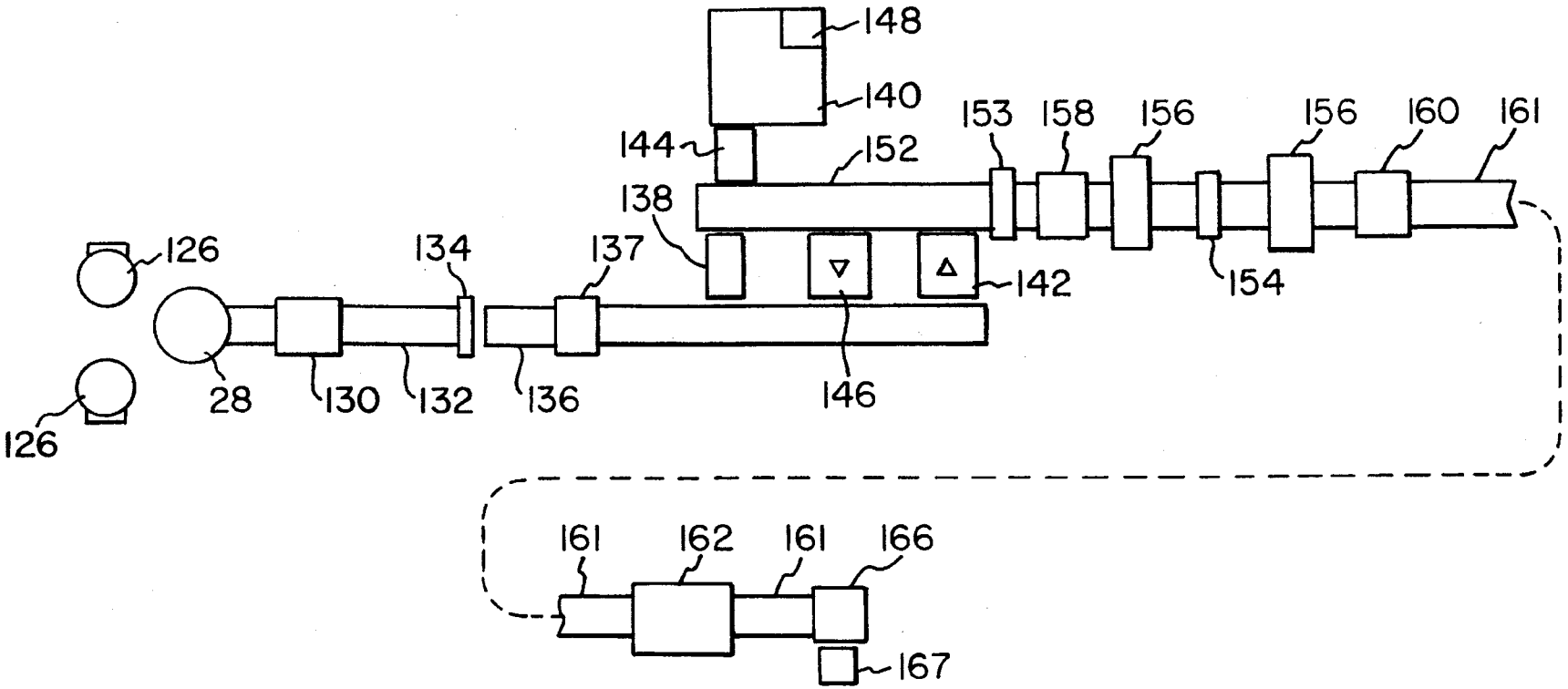
FIG. 2 is a schematic illustrating an intermediate thickness strip caster and inline hot reversing mill and coiler furnace arrangement with multiple reheat and equalizing furnaces according to a second embodiment of the present invention.

An intermediate thickness slab caster and inline hot strip and plate line including multiple furnaces and/or a multiple stand hot reversing mill according to a second embodiment of the present invention is illustrated in FIG. 2. The process line in FIG. 2 is similar in many respects to the line illustrated in the embodiment shown in FIG. 1. One or more electrical melting furnaces 126 will provide the molten metal at the entry end of the combination intermediate thickness caster and strip and plate processing line. The molten metal is fed into a ladle furnace 128 prior to being fed into the intermediate thickness caster 130. The caster 130 feeds into a curved or straight mold 132 of rectangular cross section. A torch cutoff or shear 134 is positioned at the exit end of the mold 132 to cut the strand of solidified metal into an intermediate thickness slab of desired length which may also have a width of 24 to 120 inches. The intermediate thickness slab then feeds onto a slab conveyor table 136. A hot scarfer 137 may be positioned above the slab conveyor table 136 for processing the surface of the slabs. The slab may be removed from the inline processing and stored in a slab collection and storage area 140 or it may be directly charged from the slab conveyor table 136 into an entry side of an equalizing or reheat furnace 142. The preferred furnace 142 is of a walking beam type, although a roller hearth furnace could be utilized in certain applications. The various slabs are fed through the furnace 142 and removed in a conventional manner and placed on a feed and run back table 152 positioned at the exit of the furnace 142.

When slabs are transferred to the slab collection and storage area 140, they can be removed from slab conveyor table 136 by a slab transfer table 138 operating transverse to the processing line. The slab transfer table 138 will transfer a slab from the slab conveyor table 136 to the feed and run back table 152. A second slab transfer table 144 is positioned adjacent the feed and run back table 152 to transfer slabs from the feed and run back table 152 to the slab collection and storage area 140. An alternative arrangement would combine the first and second slab transfer tables 138 and 144 into a single transfer table extending from the slab conveyor table to the slab collection and storage area 140 with the feed and run back table 152 extending from and receiving slabs from an intermediate portion of the combined slab transfer table.

A furnace 146 is positioned between the slab conveyor table 136 and the feed and run back table 152 and positioned adjacent the furnace 142. The furnace 146 may have an entrance side on the feed and run back table 152 and an exit end on the slab conveyor table 136. The slab storage area additionally includes a slab conditioning section 148 wherein further surface processing on the slabs can be performed, as needed.

The disclosed dual furnace and slab loading and unloading arrangement provides for great versatility in slab sourcing and processing. As discussed above, a slab cast from the intermediate thickness caster 130 can be fed directly through furnace 142 onto the feed and run back table 152 and into the processing line. Because the intermediate thickness slabs retain heat to a much greater extent than the thin slabs, the temperature equalization is generally all that will be required in many modes of operation.

The present arrangement additionally provides for transferring a slab from a position inline on the slab conveyor table 136 to the slab collection and storage area 140 through slab transfer tables 138 and 144. Such storage may be required to allow continuous casting to continue when a breakdown downstream in the processing line has occurred or, alternatively, allows for removing individual slabs for further processing in the slab conditioning section 148 such as due to any undesirable surface defects. The present arrangement provides for great variety in bringing slabs from the slab collection and storage area 140 back in the processing line.

In short delays, the slab may be passed directly onto the feed and run back table 152 by the slab transfer table 144 for subsequent processing. A second alternative would be to transfer a slab onto the slab conveyor table 136 through both slab transfer tables 138 and 144. The slab can then continue down through furnace 142 and to the feed and run back table 152 for processing. Where cold slabs are being re-introduced into the processing line, the present arrangement allows for the slab to be transferred to the slab conveyor table 136 through the reheat furnace 146 which will have a capacity to add Btu's to bring the slab up to the appropriate temperature for subsequent processing. The present arrangement additionally provides for introducing outsourced slabs into the processing line. Outsourced slabs refer to slabs which were not cast on the intermediate thickness caster 130. Such outsourced slabs may have any thickness, including a thickness greater than that cast on the intermediate thickness caster 130 and/or a chemistry different than what can be produced or achieved in electric melting furnaces 126 and ladle furnace 128. The additional ability of incorporating outsourced slabs into the processing line provides additional options for a more complete matching of the speed of the intermediate thickness caster 130 and the supply of outsourced slabs to the downstream processing.

An alternative embodiment of the present invention is contemplated wherein furnace 146 has an entrance side on the slab conveyor table 136 and an exit side on the feed and run back table 152. In such an arrangement, the slabs from the slab collection and storage area 140 would generally be supplied to the slab conveyor table 136 and then through an appropriate one of the furnaces 142 or 146. In this alternative arrangement, both furnaces would generally be operated in the same manner. In the embodiment disclosed in FIG. 2, furnace 146 can be utilized and operated as a reheat furnace whereas furnace 142 can be generally operated as an equalizing-type furnace.

The present arrangement additionally provides for directly transferring an appropriate slab from the slab conveyor table 136 to the feed and run back table 152 for subsequent processing without going through either of the furnaces 142 or 146. Such procedure would only be possible if the cast slab already contains an appropriate rolling temperature throughout. This alternative is simply intended to illustrate the inherent flexibility of the present design.

The slabs positioned on the feed and run back table 152 for subsequent working are passed through a conventional descaler 153. As discussed above, such a descaler process could be detrimental to 2 inch thin cast slabs.

Downstream of feed and run back table 152 and aligned therewith is a hot reversing mill which includes a pair of four-high rolling mill stands 156 configured to operate in tandem. Positioned between the pair of rolling mill stands 156 is an adjustable vertical edger 154. Vertical edger 154 is intended to be used conventionally or to taper the leading and trailing ends, respectively, of the slab on the first pass through the mill so as to compensate for the flaring out of the extreme ends which occurs during subsequent rolling. Such tapering can be controlled by the AGC, and the vertical edger can be passively driven by the twin stands of the mill. The effectiveness of the tapered ends can be monitored by a width gauge at the exit end of the downstream hot reversing stand wherein a fingerprint of the width is taken and adjustments are made through a feedback loop to the vertical edger, where necessary.

Upstream and downstream coiler furnaces 158 and 160, respectively, are positioned on either side of the pair of rolling mill stands 156 of the hot reversing mill. A run out table 161 extends downstream from the coiler furnace 160. A cooling station 162, such as laminar flow cooling, is downstream of the downstream coiler furnace 160 and extends along the run out table 161. Downstream of the cooling station 162 is an upcoiler 166 which can be operated in conjunction with a coil car 167. A subsequent finishing line may be provided substantially the same as described above in FIG. 1 which includes shear 68, transfer table 70, final processing line 71, plate side shear 72, plate end shear 74 and plate piler 76.

The provision of tandem operated twin reversing stands 156 in the hot reversing mill of the present invention includes increased processing tonnages as well as the ability to achieve lighter gauges such as 0.040 inch, which are of increasing importance in many industries such as the building industry where light gauge hot mill product is formed into studs and the like to replace lumber. The additional expense of incorporating a twin stand reversing mill rather than a single stand reversing mill is justified by the increased productivity and versatility and the incorporation of outsourced slabs from the slab collection and storage area 140, as discussed above. As noted, such outsourced slabs may have a thickness greater than those cast in the caster 130 and can provide for an even greater variety of product mix. The following Examples illustrate such a product mix.

EXAMPLE I

A 48.99 inch wide×0.040 inch thick sheet in coil form is produced from a 5 ½ inch cast slab in accordance with the following rolling schedule:

EXAMPLE I (TANDEM REVERSING MILL)

24.495 TONS 1000. PIW

ROLLING SCHEDULE HSM - 48.99-5.5000/.0400

| PASS NO. | MILL STAND NAME | GAUGE IN. | % RED | DRAFT IN. | BITE ANGLE DEG. | LENGTH FT. | ELAPSED TIME SEC. |
|---|---|---|---|---|---|---|---|
| 0 | FCE: | 5.5000 | .0 | .000 | .00 | 53.5 | .00 |
| 1 | TF1: | 3.9350 | 28.5 | 1.565 | 17.99 | 74.8 | 9.09 |
| 2 | TF2: | 2.4300 | 38.2 | 1.505 | 17.64 | 121.2 | 14.86 |
| 3 | TF2: | 1.3700 | 43.6 | 1.060 | 14.79 | 214.9 | 50.47 |
| 4 | TF1: | .6400 | 53.3 | .730 | 12.26 | 460.1 | 55.39 |
| 5 | TF1: | .3250 | 49.2 | .315 | 8.05 | 906.1 | 132.76 |
| 6 | TF2: | .1788 | 45.0 | .146 | 5.48 | 1646.9 | 136.85 |
| 7 | TF2: | .1073 | 40.0 | .072 | 3.83 | 2744.4 | 264.82 |
| 8 | TF1: | .0697 | 35.0 | .038 | 2.78 | 4224.8 | 268.43 |
| 9 | TF1: | .0470 | 32.6 | .023 | 2.16 | 6265.3 | 466.76 |
| 10 | TF2: | .0400 | 14.9 | .007 | 1.20 | 7361.8 | 466.76 |

| PASS NO. | MILL STAND NAME | GAUGE IN. | ENTRY TEMP. DEG. F. | EXIT TEMP. DEG. F. | ROLL FORCE LB x 10**6 | TORQUE LB-FT x 10**6 | HORSE POWER | LOAD RATIO | RMS TIME SEC. |
|---|---|---|---|---|---|---|---|---|---|
| 0 | FCE: | 5.5000 | 2250.00 | 2250.00 | .0000 | .0000 | 0. | .0000 | .00 |
| 1 | TF1: | 3.9350 | 2207.52 | 2200.11 | 2.7560 | 1.1437 | 12842. | 1.9441 | 34.35 |
| 2 | TF2: | 2.4300 | 2197.20 | 2204.63 | 3.2310 | 1.3135 | 23883. | 2.2326 | 45.30 |
| 3 | TF2: | 1.3700 | 2143.36 | 2121.95 | 3.6420 | 1.2393 | 13158. | 2.1064 | 157.96 |
| 4 | TF1: | .6400 | 2107.87 | 2127.08 | 4.0939 | 1.1498 | 26134. | 1.9544 | 129.33 |
| 5 | TF1: | .3250 | 2068.29 | 2014.94 | 4.0374 | .7352 | 13789. | 1.2496 | 120.82 |
| 6 | TF2: | .1788 | 2000.37 | 2014.71 | 3.5497 | .4304 | 14673. | 1.0481 | 82.76 |
| 7 | TF2: | .1073 | 1928.23 | 1934.41 | 3.5588 | .2906 | 9652. | .6895 | 60.83 |
| 8 | TF1: | .0697 | 1847.25 | 1855.03 | 3.7157 | .2076 | 10617. | .7583 | 72.42 |
| 9 | TF1: | .0470 | 1752.82 | 1752.20 | 4.9793 | .1901 | 8272. | .5909 | 69.25 |
| 10 | TF2: | .0400 | 1725.05 | 1702.53 | 3.0653 | .0556 | 2846. | .2033 | 8.11 |

Distance/Length Ratio: .5000
Reversing Tandem Mill Peak Production: 188.93 TPH
Coiling Begins at Pass Number: 4 *TF1*
Tandem Passes Begin at Pass Number: 1 *TF1*
Distance Between CFce #1 and Mill: 35.00 ft.
Distance Between Mill and CFce #2: 35.00 ft.
Coiling Furnace Diameter: 54.00 in.
Coiling Furnace Temperature: 1650.00 Deg. F.
Acceleration/Deceleration Rate: 250.00 FPM/sec.
Final Body Temperature at TS: 1702.53 Deg. F.

Example I illustrates one of a wide variety of product types which can be rolled with the present system. As illustrated in this Example, the present mill can economically hot roll down to 0.040 inch thick. The provision of the twin stands allows for accurately rolling down to these light gauges for which there is an increased market demand.

EXAMPLE II

A 55 inch wide×0.060 inch thick sheet in coiled form is produced from a 5 ½ inch cast slab in accordance with the following rolling schedule:

EXAMPLE II (TANDEM REVERSING MILL)

27.5 TONS 1000. PIW

ROLLING SCHEDULE HSM - 55.00-5.5000/0.0600

| PASS NO. | MILL STAND NAME | GAUGE IN. | % RED | DRAFT IN. | BITE ANGLE DEG. | LENGTH FT. | ELAPSED TIME SEC. |
|---|---|---|---|---|---|---|---|
| 0 | FCE: | 5.5000 | .0 | .000 | .00 | 53.5 | .00 |
| 1 | TF1: | 3.9480 | 28.4 | 1.560 | 17.97 | 74.7 | 8.59 |
| 2 | TF2: | 2.5700 | 34.8 | 1.370 | 16.83 | 114.6 | 14.22 |
| 3 | TF2: | 1.6000 | 37.7 | .970 | 14.14 | 184.0 | 42.79 |
| 4 | TF1: | .8500 | 46.9 | .750 | 12.43 | 346.4 | 47.49 |
| 5 | TF1: | .4750 | 44.1 | .375 | 8.78 | 619.9 | 106.78 |
| 6 | TF2: | .2470 | 48.0 | .228 | 6.84 | 1192.2 | 110.94 |
| 7 | TF2: | .1480 | 40.1 | .099 | 4.51 | 1989.7 | 218.88 |
| 8 | TF1: | .0941 | 36.4 | .054 | 3.33 | 3129.3 | 222.59 |
| 9 | TF1: | .0706 | 25.0 | .023 | 2.20 | 4171.0 | 371.84 |
| 10 | TF2: | .0600 | 15.0 | .011 | 1.47 | 4907.8 | 371.84 |

-continued 27.5 TONS 1000. PIW

ROLLING SCHEDULE HSM - 55.00-5.5000/0.0600

| PASS NO. | MILL STAND NAME | GAUGE IN. | ENTRY TEMP. DEG. F. | EXIT TEMP. DEG. F. | ROLL FORCE LB × 10**6 | TORQUE LB-FT × 10**6 | HORSE POWER | LOAD RATIO | RMS TIME SEC. |
|---|---|---|---|---|---|---|---|---|---|
| 0 | FCE: | 5.5000 | 2250.00 | 2250.00 | .0000 | .0000 | 0. | .0000 | .00 |
| 1 | TF1: | 3.9480 | 2208.27 | 2201.51 | 3.0812 | 1.2766 | 15141. | 2.1699 | 40.46 |
| 2 | TF2: | 2.5700 | 2198.78 | 2204.63 | 3.3368 | 1.2942 | 23531. | 2.1997 | 41.58 |
| 3 | TF2: | 1.6000 | 2154.98 | 2138.02 | 3.5295 | 1.1492 | 13876. | 1.9534 | 109.02 |
| 4 | TF1: | .8500 | 2127.11 | 2140.93 | 4.0143 | 1.1449 | 26023. | 1.9461 | 102.40 |
| 5 | TF1: | .4750 | 2096.08 | 2104.49 | 3.6429 | .7284 | 12912. | 1.2380 | 90.89 |
| 6 | TF2: | .2470 | 2092.28 | 2107.45 | 3.0257 | .5876 | 20038. | 1.4313 | 117.09 |
| 7 | TF2: | .1480 | 2024.39 | 2027.03 | 3.4411 | .3386 | 9785. | .6990 | 52.74 |
| 8 | TF1: | .0941 | 1958.84 | 1955.66 | 3.5483 | .2473 | 11241. | .8029 | 68.31 |
| 9 | TF1: | .0706 | 1854.68 | 1842.76 | 3.0025 | .1305 | 5041. | .3601 | 19.35 |
| 10 | TF2: | .0600 | 1818.74 | 1795.94 | 2.1214 | .0579 | 2634. | .1882 | 5.21 |

Reversing Tandem Mill Peak Production: 266.20 TPH
Coiling Begins at Pass Number: 4 *TF1*
Tandem Passes Begin at Pass Number: 1 *TF1*
Distance Between CFce #1 and Mill: 35.00 ft.
Distance Between Mill and CFce #2: 35.00 ft.
Coiling Furnace Diameter: 54.00 in.
Coiling Furnace Temperature: 1650.00 Deg. F.
Acceleration/Deceleration Rate: 250.00 FPM/sec.
Final Body Temperature at TS: 1795.94 Deg. F.

Example II, like Example I, illustrates the versatility of the present system in hot rolling thin gauges. These hot rolled narrow gauge products, such as about 0.040 inch and about 0.060 inch thick, are able to be utilized as final end products in situations in which the final end product is generally not exposed and does not require any surface finishing. Metal construction studs, for example 0.040 inch galvanized studs, represent one final end product that can be hot rolled by the present invention. This is a distinct advantage over the known prior art which would generally hot roll somewhere above 0.080 inch thick then pickle and finish the product on a cold mill with a subsequent anneal and temper rolling.

EXAMPLE III

A 62 inch wide×0.090 inch thick sheet in coil form is produced from a 10 inch outsourced slab in accordance to the following schedule:

31 TONS 1000. PIW

ROLLING SCHEDULE HSM - 62.00-10.00/0.0900

| PASS NO. | MILL STAND NAME | GAUGE IN. | % RED | DRAFT IN. | BITE ANGLE DEG. | LENGTH FT. | ELAPSED TIME SEC. |
|---|---|---|---|---|---|---|---|
| 0 | FCE: | 10.0000 | .0 | .000 | .00 | 29.5 | .00 |
| 1 | TF1: | 8.5500 | 14.5 | 1.450 | 17.32 | 34.4 | 3.11 |
| 2 | TF2: | 7.1000 | 17.0 | 1.450 | 17.32 | 41.5 | 8.18 |
| 3 | TF2: | 5.6500 | 20.4 | 1.450 | 17.32 | 52.1 | 12.38 |
| 4 | TF1: | 4.2000 | 25.7 | 1.450 | 17.32 | 70.1 | 17.69 |
| 5 | TF1: | 2.9300 | 30.2 | 1.270 | 16.20 | 100.5 | 26.69 |
| 6 | TF2: | 1.8700 | 36.2 | 1.060 | 14.79 | 157.5 | 32.37 |
| 7 | TF2: | 1.12000 | 40.1 | .750 | 12.43 | 262.9 | 62.21 |
| 8 | TF1: | .6600 | 41.1 | .460 | 9.73 | 446.2 | 66.30 |
| 9 | TF1: | .3878 | 41.2 | .272 | 7.48 | 759.4 | 119.01 |
| 10 | TF2: | .2521 | 35.0 | .136 | 5.28 | 1168.2 | 122.80 |
| 11 | TF2: | .1765 | 30.0 | .076 | 3.94 | 1668.6 | 192.43 |
| 12 | TF1: | .1324 | 25.0 | .044 | 3.01 | 2224.3 | 195.91 |
| 13 | TF1: | .1059 | 20.0 | .027 | 2.33 | 2780.9 | 276.46 |
| 14 | TF2: | .0900 | 15.0 | .016 | 1.81 | 3272.2 | 276.46 |

| PASS NO. | MILL STAND NAME | GAUGE IN. | ENTRY TEMP. DEG. F. | EXIT TEMP. DEG. F. | ROLL FORCE LB × 10**6 | TORQUE LB-FT × 10**6 | HORSE POWER | LOAD RATIO | RMS TIME SEC. |
|---|---|---|---|---|---|---|---|---|---|
| 0 | FCE: | 10.0000 | 2250.00 | 2250.00 | .0000 | .0000 | 0. | .0000 | .00 |
| 1 | TF1: | 8.5500 | 2227.38 | 2225.39 | 3.2570 | 1.3008 | 19641. | 2.2110 | 15.21 |
| 2 | TF2: | 7.1000 | 2224.30 | 2226.34 | 3.2540 | 1.2996 | 23630. | 2.2090 | 15.18 |
| 3 | TF2: | 5.6500 | 2220.03 | 2217.71 | 3.2821 | 1.3108 | 22147. | 2.2281 | 20.89 |
| 4 | TF1: | 4.2000 | 2215.05 | 2218.71 | 3.2788 | 1.3095 | 29763. | 2.2258 | 20.84 |
| 5 | TF1: | 2.9300 | 2194.47 | 2198.55 | 3.5122 | 1.3115 | 19976. | 2.2292 | 44.72 |
| 6 | TF2: | 1.8700 | 2195.76 | 2193.42 | 3.8134 | 1.2987 | 30993. | 2.2138 | 44.10 |
| 7 | TF2: | 1.1200 | 2125.80 | 2135.32 | 4.1445 | 1.1833 | 22189. | 2.0114 | 120.70 |

-continued

31 TONS — ROLLING SCHEDULE HSM - 62.00-10.00/0.0900 — 1000. PIW

| | | | | | | | | | |
|---|---|---|---|---|---|---|---|---|---|
| 8 | TF1: | .6600 | 2121.51 | 2113.87 | 4.0563 | .9016 | 28689. | 2.0492 | 117.66 |
| 9 | TF1: | .3878 | 2076.96 | 2087.73 | 3.9993 | .6770 | 17504. | 1.2503 | 82.40 |
| 10 | TF2: | .2521 | 2077.75 | 2084.45 | 3.2680 | .3843 | 15284. | 1.0917 | 60.62 |
| 11 | TF2: | .1765 | 2030.67 | 2032.36 | 2.9640 | .2547 | 10858. | .7755 | 41.88 |
| 12 | TF1: | .1324 | 1976.73 | 1976.45 | 2.6926 | .1722 | 9786. | .6990 | 33.14 |
| 13 | TF1: | .1059 | 1916.07 | 1907.90 | 2.4442 | .1177 | 5683. | .4059 | 13.27 |
| 14 | TF2: | .0900 | 1893.44 | 1880.60 | 1.9862 | .0718 | 4081. | .2915 | 6.67 |

Reversing Tandem Mill Peak Production: 403.72 TPH
Coiling Begins at Pass Number: 8 *TF1*
Tandem Passes Begin at Pass Number: 1 *TF1*
Distance Between CFce #1 and Mill: 35.00 ft.
Distance Between Mill and CFce #2: 35.00 ft.
Coiling Furnace Diameter: 54.00 in.
Coiling Furnace Temperature: 1650.00 Deg. F.
Acceleration/Deceleration Rate: 250.00 FPM/sec.
Final Body Temperature at TS: 1880.60 Deg. F.

EXAMPLE III (TANDEM REVERSING MILL)

Example III illustrates the flexibility of the present system which can receive outsourced slabs for further processing. Such outsourced slabs may be, as here, slabs which are too thick to be cast in the intermediate thickness caster or slabs which have a specialized composition limiting where they may be produced or simply additional slabs to supplement the caster product. The rolling of outsourced slabs and the ability to store cast slabs allows the casting and rolling to be decoupled and operated independently of each other.

EXAMPLE IV

A 48 inch wide×0.125 inch thick sheet of high carbon steel (0.51–0.95 carbon) in coil form is produced from a 5 ½ inch thick cast slab in accordance to the following rolling schedule:

24.000 TONS — ROLLING SCHEDULE HSM - 48.00-5.5000/.1250 — 1000. PIW

| PASS NO. | MILL STAND NAME | GAUGE IN. | % RED | DRAFT IN. | BITE ANGLE DEG. | LENGTH FT. | ELAPSED TIME SEC. |
|---|---|---|---|---|---|---|---|
| 0 | FCE: | 5.5000 | .0 | .000 | .00 | 53.5 | .00 |
| 1 | TF1: | 3.9350 | 28.5 | 1.565 | 17.99 | 74.8 | 8.76 |
| 2 | TF2: | 2.5200 | 36.0 | 1.415 | 17.10 | 116.9 | 14.98 |
| 3 | TF2: | 1.6500 | 34.5 | .870 | 13.39 | 178.5 | 39.52 |
| 4 | TF1: | .9850 | 40.3 | .665 | 11.70 | 299.0 | 44.03 |
| 5 | TF1: | .5600 | 43.1 | .425 | 9.35 | 525.8 | 87.35 |
| 6 | TF2: | .3500 | 37.5 | .210 | 6.57 | 841.3 | 91.40 |
| 7 | TF2: | .2450 | 30.0 | .105 | 4.64 | 1201.9 | 153.78 |
| 8 | TF1: | .1830 | 25.3 | .062 | 3.57 | 1609.1 | 157.51 |
| 9 | TF1: | .1470 | 19.7 | .036 | 2.72 | 2003.2 | 230.60 |
| 10 | TF2: | .1250 | 15.0 | .022 | 2.12 | 2355.8 | 230.60 |

| PASS | MILL STAND | GAUGE | ENTRY TEMP. DEG. F. | | | EXIT TEMP. DEG. F. | | |
|---|---|---|---|---|---|---|---|---|
| NO. | NAME | IN. | Front | Tail | Diff. | Front | Tail | Diff. |
| 0 | FCE: | 5.5000 | 2250.0 | 2250.0 | .0 | 2250.0 | 2250.0 | .0 |
| 1 | TFI: | 3.9350 | 2225.0 | 2214.4 | 10.7 | 2213.6 | 2209.5 | 4.1 |
| 2 | TF2: | 2.5200 | 2208.4 | 2206.1 | 2.3 | 2216.4 | 2215.6 | .8 |
| 3 | TF2: | 1.6500 | 2131.5 | 2208.1 | 76.6 | 2125.0 | 2173.8 | 48.8 |
| 4 | TFI: | .9850 | 2120.1 | 2161.8 | 41.7 | 2135.6 | 2171.0 | 35.5 |
| 5 | TFI: | .5600 | 2119.4 | 2025.2 | 94.2 | 2123.6 | 2045.4 | 78.3 |
| 6 | TF2: | .3500 | 2093.5 | 2036.7 | 56.9 | 2094.6 | 2053.5 | 41.1 |
| 7 | TF2: | .2450 | 1879.0 | 2014.6 | 135.6 | 1892.8 | 2000.6 | 107.8 |
| 8 | TF1: | .1830 | 1882.3 | 1954.2 | 71.9 | 1891.6 | 1938.4 | 46.8 |
| 9 | TF1: | .1470 | 1835.9 | 1776.8 | 59.1 | 1811.6 | 1780.2 | 31.4 |
| 10 | TF2: | .1250 | 1762.7 | 1767.6 | 4.9 | 1736.9 | 1765.0 | 28.2 |

| PASS | MILL STAND | GAUGE | ROLL FORCE LB × 10**6 | | TORQUE LB-FT × 10**6 | |
|---|---|---|---|---|---|---|
| NO. | NAME | IN. | Front | Tail | Front | Tail |
| 0 | FCE: | 5.5000 | .0000 | .0000 | .0000 | .0000 |
| 1 | TF1: | 3.9350 | 3.3819 | 3.3961 | 1.4016 | 1.4076 |
| 2 | TF2: | 2.5200 | 3.7790 | 3.7821 | 1.4872 | 1.4884 |
| 3 | TF2: | 1.6500 | 3.6795 | 3.4730 | 1.1318 | 1.0683 |

-continued 24.000 TONS 1000. PIW

ROLLING SCHEDULE HSM - 48.00-5.5000/.1250

| | | | | | | |
|---|---|---|---|---|---|---|
| 4 | TF1: | .9850 | 3.9123 | 3.7526 | 1.0476 | 1.0048 |
| 5 | TF1: | .5600 | 3.9918 | 4.4220 | .8474 | .9387 |
| 6 | TF2: | .3500 | 3.4093 | 3.6004 | .5011 | .5292 |
| 7 | TF2: | .2450 | 3.5301 | 3.0166 | .3596 | .3073 |
| 8 | TF1: | .1830 | 2.9834 | 2.7839 | .2282 | .2129 |
| 9 | TF1: | .1470 | 2.6765 | 2.8334 | .1515 | .1595 |
| 10 | TF2: | .1250 | 2.4248 | 2.2978 | .1027 | .0980 |

| PASS NO. | MILL STAND NAME | GAUGE IN. | HORSEPOWER Front | HORSEPOWER Tail | LOAD RATIO Front | LOAD RATIO Tail | RMS TIME SEC. |
|---|---|---|---|---|---|---|---|
| 0 | FCE: | 5.5000 | 0. | 0. | .0000 | .0000 | .00 |
| 1 | TF1: | 3.9350 | 16321. | 16390. | 2.3824 | 2.3925 | 49.95 |
| 2 | TF2: | 2.5200 | 27040. | 27062. | 2.5278 | 2.5299 | 56.05 |
| 3 | TF2: | 1.6500 | 18428. | 17393. | 1.9238 | 1.8158 | 85.81 |
| 4 | TF1: | .9850 | 28572. | 27405. | 2.0408 | 1.9575 | 90.35 |
| 5 | TF1: | .5600 | 19680. | 21801. | 1.4403 | 1.5955 | 99.81 |
| 6 | TF2: | .3500 | 18623. | 19667. | 1.3302 | 1.4048 | 76.83 |
| 7 | TF2: | .2450 | 12209. | 10433. | .8721 | .7452 | 40.79 |
| 8 | TF1: | .1830 | 10373. | 9679. | .7409 | .6914 | 30.95 |
| 9 | TF1: | .1470 | 5855. | 6164. | .4182 | .4403 | 13.47 |
| 10 | TF2: | .1250 | 4669. | 4454. | .3335 | .3181 | 7.50 |

Reversing Tandem Mill Peak Production: 374.68 TPH
Coiling Begins at Pass Number: 4 *TF1*
Tandem Passes Begin at Pass Number: 1 *TF1*
Distance Between CFce #1 and Mill: 35.00 ft.
Distance Between Mill and CFce #2: 35.00 ft.
Coiling Furnace Diameter: 54.00 in.
Coiling Furnace Temperature: 1650.00 Deg. F.
Acceleration/Deceleration Rate: 250.00 FPM/sec.
Final Front Temperature at TS: 1736.86 Deg. F.
Final Tail Temperature at TS: 1765.03 Deg. F.

EXAMPLE IV (TANDEM REVERSING MILL)

EXAMPLE V

A 60 inch wide×0.100 inch thick sheet in coil form is produced from a 5 inch cast slab of low carbon steel according to the following rolling schedule:

30.000 TONS 1000. PIW

ROLLING SCHEDULE HSM - 60.00-5.0000/.1000

| PASS NO. | MILL STAND NAME | GAUGE IN. | % RED | DRAFT IN. | BITE ANGLE DEG. | LENGTH FT. | ELAPSED TIME SEC. |
|---|---|---|---|---|---|---|---|
| 0 | FCE: | 5.0000 | .0 | .000 | .00 | 58.9 | .00 |
| 1 | TF1: | 3.7000 | 26.0 | 1.300 | 17.37 | 79.6 | 9.20 |
| 2 | TF2: | 2.4000 | 35.1 | 1.300 | 17.37 | 122.7 | 15.29 |
| 3 | TF2: | 1.3750 | 42.7 | 1.025 | 15.41 | 214.1 | 40.09 |
| 4 | TF1: | .8250 | 40.0 | .550 | 11.28 | 356.9 | 44.52 |
| 5 | TF1: | .4580 | 44.5 | .367 | 9.21 | 642.9 | 87.66 |
| 6 | TF2: | .2920 | 36.2 | .166 | 6.19 | 1008.4 | 92.02 |
| 7 | TF2: | .2085 | 28.6 | .083 | 4.39 | 1412.2 | 154.38 |
| 8 | TF1: | .1500 | 28.1 | .058 | 3.67 | 1963.0 | 158.35 |
| 9 | TF1: | .1176 | 21.6 | .032 | 2.73 | 2503.8 | 230.99 |
| 10 | TF2: | .1000 | 15.0 | .018 | 2.01 | 2944.5 | 230.99 |

| PASS NO. | MILL STAND NAME | GAUGE IN. | ENTRY TEMP. DEG. F. | EXIT TEMP. DEG. F. | ROLL FORCE LB × 10**6 | TORQUE LB-FT × 10**6 | HORSE POWER | LOAD RATIO | RMS TIME SEC. |
|---|---|---|---|---|---|---|---|---|---|
| 0 | FCE: | 5.0000 | 2300.00 | 2300.00 | .0000 | .0000 | 0. | .0000 | .00 |
| 1 | TF1: | 3.7000 | 2257.40 | 2245.50 | 2.6914 | .9614 | 12731. | 1.4293 | 16.91 |
| 2 | TF2: | 2.4000 | 2240.90 | 2244.50 | 3.1851 | 1.1359 | 23190. | 1.6888 | 26.32 |
| 3 | TF2: | 1.3750 | 2150.30 | 2149.90 | 3.8551 | 1.2119 | 27833. | 1.8817 | 76.11 |
| 4 | TF1: | .8250 | 2146.10 | 2156.40 | 3.2415 | .7469 | 28591. | 1.2744 | 35.96 |
| 5 | TF1: | .4580 | 2133.40 | 2040.00 | 3.9262 | .7340 | 23884. | 1.0912 | 50.88 |
| 6 | TF2: | .2920 | 2014.20 | 2008.40 | 3.1308 | .3886 | 19835. | .8855 | 30.50 |

-continued 30.000 TONS 1000. PIW

ROLLING SCHEDULE HSM - 60.00-5.0000/.1000

| | | | | | | | | | |
|---|---|---|---|---|---|---|---|---|---|
| 7 | TF2: | .2085 | 1857.00 | 1844.40 | 2.9526 | .2559 | 11744. | .5243 | 14.69 |
| 8 | TF1: | .1500 | 1856.80 | 1845.10 | 2.8790 | .2052 | 13091. | .5814 | 19.46 |
| 9 | TF1: | .1176 | 1790.80 | 1757.90 | 2.6673 | .1368 | 7420. | .3313 | 7.43 |
| 10 | TF2: | .1000 | 1712.50 | 1677.20 | 12.2102 | .0801 | 5110. | .2281 | 3.12 |

Reversing Tandem Mill Peak Production: 467.52 TPH
Coiling Begins at Pass Number: 4 *TF1*
Distance Between CFce #1 and Mill: 27.00 ft.
Distance Between Mill and CFce #2: 27.00 ft.
Coiling Furnace Diameter: 54.00 in.
Coiling Furnace Temperature: 1750.00 Deg. F.
Acceleration/Deceleration Rate: 250.00 FPM/sec.
Final Temperature at TS: 1677.17 Deg. F.

EXAMPLE V (TANDEM REVERSING MILL)

Examples IV and V show the range of grades producible on the present invention providing the broad product mix needed for a competitive mill.

Although the present invention has been described in considerable detail with reference to certain preferred versions thereof, other versions are possible. Therefore, the spirit and scope of the appended claims should not be limited to the description of the preferred versions contained herein.

What is claimed is:

1. An intermediate thickness slab caster and inline hot strip and plate line comprising:

a) an intermediate thickness continuous strip caster;

b) an inline cutoff downstream of said caster for cutting an intermediate thickness slab to a desired length;

c) a slab conveyor table inline with said cutoff;

d) a slab transfer means adjacent said slab conveyor table operable transverse of said slab conveyor table;

e) a feed and run back table positioned in communication with said slab transfer means;

f) a slab collection and storage area adjacent said slab transfer means adapted to selectively receive slabs therefrom;

g) a first reheat furnace positioned between said feed and run back table and said slab conveyor table;

h) a second reheat furnace downstream of and adjacent said first reheat furnace and having an entry end inline with said slab conveyor table and an exit inline with said feed and run back table;

i) a hot reversing mill means inline with said feed and run back table for reducing a slab on said feed and run back table to an intermediate product of a thickness sufficient for coiling in a number of flat passes; and j) a pair of coiler furnaces positioned inline with said feed and run back table, one located upstream of said hot reversing mill means and the other located downstream, said coiler furnaces capable of receiving and paying out said intermediate product as it is passed between said coiler furnaces and through said hot reversing mill means so as to be reduced to an end product.

2. The apparatus of claim 1 wherein said first reheat furnace has an entry end inline with said feed and run back table and an exit inline with said slab conveyor table.

3. The apparatus of claim 1 wherein said hot reversing mill means includes a pair of rolling mill stands operated in tandem.

4. The apparatus of claim 3 further including an adjustable vertical edger positioned between said pair of rolling mill stands.

5. The apparatus of claim 1 wherein said slab transfer means includes a first slab transfer table positioned between said slab conveyor table and said feed and run back table, and a second slab transfer table positioned between said feed and run back table and said slab collection and storage area.

6. An intermediate thickness slab caster and inline hot strip and plate line comprising:

a) an intermediate thickness continuous strip caster;

b) an inline cutoff downstream of said caster for cutting an intermediate thickness slab;

c) a slab conveyor table inline with said cutoff;

d) a slab loading and unloading means adjacent said slab conveyor table for removing and supplying slabs thereto;

e) a slab collection and storage area adjacent said slab loading and unloading means for receiving and supplying slabs thereto;

f) at least one reheat furnace having an entry end inline with said slab conveyor table for receiving slabs therefrom;

g) a feed and run back table positioned at an exit end of said at least one reheat furnace;

h) a hot reversing mill inline with said feed and run back table for reducing a slab on said fed and run back table to an intermediate product in a number of flat passes, said hot reversing mill including a pair of rolling mill stands adapted to be operated in tandem; and i) a pair of coiler furnaces positioned inline with said feed and run back table, one located upstream of said hot reversing mill means and the other located downstream, said coiler furnaces capable of receiving and paying out said intermediate product as it is passed between said coiler furnaces and through said hot reversing mill means so as to be reduced to an end product.

7. The apparatus of claim 6 wherein said slab loading and unloading means includes:

i) a first slab transfer means adjacent said slab conveyor table operable transverse of said slab conveyor table, wherein said feed and run back table is positioned adjacent an end of said first slab transfer means; and ii) a second slab transfer means adjacent said feed and run back table, wherein said slab collection and storage area is adapted to receive slabs from said second slab transfer table.

8. The apparatus of claim 6 further including a reheat furnace having an entry end inline with said feed and run back table and an exit end inline with said slab conveyor table.

9. The apparatus of claim 6 further including an adjustable vertical edger positioned between said pair of rolling mill stands.

10. A method of processing metal slabs comprising the steps of:

a) providing an intermediate thickness continuous caster and inline cutoff for casting an intermediate thickness strand and cutting said strand into a slab of predetermined length;

b) providing a slab loading and unloading means adjacent a slab collection and storage area for moving slabs between a position inline with said intermediate thickness caster and said slab collection and storage area;

c) feeding a slab to be worked into an inline heating furnace wherein said slab to be worked is from either said intermediate thickness caster or said slab collection and storage area;

d) extracting said slab to be worked from said inline heating furnace onto a continuous processing line including a hot reversing mill having a coiler furnace on each of an upstream and downstream side thereof;

e) flat passing said slab to be worked back and forth through said mill to form an intermediate product of a thickness sufficient for coiling;

f) coiling said intermediate product in one of said coiler furnaces; and g) passing said coiled intermediate product back and forth through said mill to reduce said coiled intermediate product to an end product of desired thickness, said intermediate product being collected in and fed out of each of said coiler furnaces on each pass through said hot reversing mill.

11. The method of claim 10 including casting said strand to a thickness between 3.50 and 5.50 inches.

12. The method of claim 10 further including supplying at least one slab to be worked to said heating furnace and said continuous processing line from said slab collection and storage area which was not cast in said intermediate thickness caster.

13. The method of claim 12 wherein said at least one slab to be worked which was not cast in said caster has a thickness greater than said slabs cast by said caster.

14. The method of claim 10 further including the step of surface conditioning at least one slab in said slab collection and storage area.

15. The method of claim 10 wherein said hot reversing mill includes a pair of rolling mill stands operated in tandem.

16. The method of claim 15 further including an adjustable vertical edger positioned between said pair of rolling mill stands.

17. The method of claim 10 further including a second heating furnace adjacent said inline heating furnace.

18. The method of claim 10 wherein said intermediate product is formed after no more than three flat passes through said hot reversing mill when said slab to be worked is cast in said caster.

19. The method of claim 10 wherein said end product has a thickness of equal to or less than 0.060 inch.

20. The method of claim 19 wherein said end product has a thickness of about 0.040 inch.

21. A method of processing metal slabs comprising the steps of:

a) continuously casting an intermediate thickness strand;

b) cutting said strand into a slab of predetermined length;

c) feeding said slab into at least one inline heating furnace;

d) extracting said slab to be worked from said inline heating furnace onto a continuous processing line including a hot reversing mill having a coiler furnace on each of an upstream and downstream side thereof;

e) flat passing said slab to be worked back and forth through said mill to form an intermediate product of a thickness sufficient for coiling;

f) coiling said intermediate product in one of said coiler furnaces; and g) passing said coiled intermediate product back and forth through said mill to reduce said coiled intermediate product to an end product of a thickness of equal to or less than about 0.060 inch, said intermediate product being collected in and fed out of each of said coiler furnaces on each pass through said hot reversing mill.

22. The method of claim 21 wherein said end product has a thickness of about 0.040 inch.

23. The method of claim 21 wherein said hot reversing mill includes a pair of rolling mill stands operated in tandem.

24. A method of processing metal slabs comprising the steps of:

a) continuously casting an intermediate thickness strand;

b) cutting said strand into a slab of predetermined length;

c) selectively feeding said slab to either i) a continuous processing line including a hot reversing mill having a coiler furnace on each of an upstream and downstream side thereof, or ii) an inline furnace from which said slab exits to said continuous processing line, or iii) a slab collection and storage area and subsequently transferring said slab to said furnace;

d) flat passing said slab to be worked back and forth through said mill to form an intermediate product of a thickness sufficient for coiling;

e) coiling said intermediate product in one of said coiler furnaces; and f) passing said coiled intermediate product back and forth through said mill to reduce said coiled intermediate product to an end product of desired thickness, said intermediate product being collected in and fed out of each of said coiler furnaces on each pass through said hot reversing mill.

* * * * *